US008849136B2

(12) United States Patent
Reihl

(10) Patent No.: US 8,849,136 B2
(45) Date of Patent: Sep. 30, 2014

(54) METHOD TO SET THE PRINT QUALITY IN AN ELECTROPHOTOGRAPHIC PRINTER

(71) Applicant: Heiner Reihl, Freising (DE)

(72) Inventor: Heiner Reihl, Freising (DE)

(73) Assignee: Océ Printing GmbH & Co. KG, Poing (DE)

( * ) Notice: Subject to any disclaimer, the term of this patent is extended or adjusted under 35 U.S.C. 154(b) by 0 days.

(21) Appl. No.: 14/179,890

(22) Filed: Feb. 13, 2014

(65) Prior Publication Data

US 2014/0226996 A1 Aug. 14, 2014

(30) Foreign Application Priority Data

Feb. 14, 2013 (DE) ..... 10 2013 101 446

(51) Int. Cl.
*G03G 15/00* (2006.01)
*G03G 13/02* (2006.01)

(52) U.S. Cl.
CPC ..... *G03G 13/02* (2013.01)
USPC ..... 399/48

(58) Field of Classification Search
USPC ..... 399/38, 46, 48, 50
See application file for complete search history.

(56) References Cited

U.S. PATENT DOCUMENTS

| | | | | |
|---|---|---|---|---|
| 5,298,943 | A * | 3/1994 | Ide et al. | 399/39 |
| 6,684,036 | B2 * | 1/2004 | Kubota et al. | 399/55 |
| 8,170,433 | B2 * | 5/2012 | Kubo | 399/50 |
| 2011/0150534 | A1 | 6/2011 | Kopp | |

FOREIGN PATENT DOCUMENTS

| | | |
|---|---|---|
| DE | 102008048256 | 4/2010 |
| DE | 102009060334 | 6/2011 |
| DE | 102010015985 | 9/2011 |
| JP | 61238070 | 10/1986 |
| JP | 02077766 | 3/1990 |

* cited by examiner

*Primary Examiner* — Hoan Tran
(74) *Attorney, Agent, or Firm* — Schiff Hardin LLP

(57) ABSTRACT

In a method to determine an electrical potential at a predetermined point on a surface of a photoconductor rotating with process speed in an electrophotografic printer, a charge reversal station is arranged at the photoconductor to reverse a charge of the photoconductor. A potential measurement probe is provided adjacent to the photoconductor to measure a potential at the photoconductor. The photoconductor is operated with a speed reduced from the process speed in a ratio of a distance between the charge reversal station and the potential measurement probe and the distance between the charge reversal station and the predetermined point. The potential at the photoconductor is measured via the potential measurement probe which creates a measurement value at the reduced speed. The photoconductor is accelerated to the process speed. The measurement value of the potential measurement probe is used as the electrical potential at the predetermined point.

11 Claims, 3 Drawing Sheets

METHOD TO SET THE PRINT QUALITY IN AN ELECTROPHOTOGRAPHIC PRINTER

BACKGROUND

The exemplary embodiment concerns an electrophotographic printer to print a recording medium with toner particles of a developer mixture that are applied with the aid of a liquid developer or dry toner mixture. In the following, liquid developer is used as an example of a developer mixture in the explanation of the exemplary embodiment without thereby limiting the invention to this.

In such printers, a charge image generated on a photoconductor is inked with the aid of the liquid developer by means of electrophoresis. The toner image that is created in such a manner is transferred indirectly (via a transfer element) or directly onto a recording medium. The liquid developer has toner particles and carrier fluid in a desired ratio. Mineral oil is advantageously used as a carrier fluid. In order to provide the toner particles with an electrostatic charge, charge control substances can be added to the liquid developer. Further additives can additionally be added in order, for example, to achieve the desired viscosity or a desired drying response of the liquid developer.

Such printers are known, for example from DE 10 2010 015 985 A1, DE 10 2008 048 256 A1 or DE 10 2009 060 334 A1.

A print group of an electrophotographic printer essentially comprises an electrophotography station, a developer station and a transfer station. The core of the electrophotography station is a photoelectric image medium that has on its surface a photoelectric layer (what is known as a photoconductor). For example, the photoconductor is designed as a photoconductor roller that rotates past different elements to generate a print image. The photoconductor roller is initially cleaned of all contaminants. For this, an erasure light is present that erases charges that still remain on the surface of the photoconductor roller. After the erasure light, a cleaning device mechanically cleans off the photoconductor roller in order to remove toner particles (possibly dust particles and remaining carrier fluid) still present on the surface of the photoconductor roller. The photoconductor roller is subsequently charged by a charging device to a predetermined electrostatic charge potential. For this, for example, the charge device has a corotron device that advantageously comprises multiple corotrons. By adjusting the current (called corotron current in the following) that is supplied to the corotron device, the charge potential of the photoconductor roller is controllable. A character generator is arranged after the charging device, which character generator discharges the photoconductor roller via optical radiation depending on the desired print image (called discharge potential in the following). A latent charge image of the print image is thereby created.

The latent charge image of the print image that is generated by the character generator is inked with toner particles by the developer station. For this, for example, the developer station has a rotating developer roller that directs a layer of liquid developer towards the photoconductor roller. A BIAS voltage is applied to the developer roller, wherein a potential develops on its surface. A development gap (called a nip) exists between the rollers, in which an electrical field is generated due to the development voltage (formed by the difference between the potential on the developer roller and the discharge potential on the photoconductor roller) applied at the development gap, due to which electrical field the charged toner particles migrate electrophoretically from the developer roller onto the photoconductor roller at the image points at the photoconductor roller. This toner transfer is defined by the field strength of the electrical field in the developer gap. The field develops between the development point on the photoconductor roller (which development point lies adjacent to the developer roller at the developer gap) and the surface of the developer roller (in the following, the difference between the discharge potential and the photoconductor roller at the development point and the potential on the surface of the developer roller at the developer gap is called the development voltage). No toner passes onto the photoconductor roller in the non-image points because the direction of the electrical field that results from the potential on the developer roller and the charge potential at the development point on the photoconductor roller repels the charged toner particles (in the following, the difference of these potentials is called the contrast voltage). The inked image rotates with the photoconductor roller up to a transfer point in which the inked image is transferred onto a transfer roller. The print image can be transfer-printed from the transfer roller onto the recording medium.

The development voltage and the contrast voltage at the development gap should be kept constant to stabilize the electrophotographic printing process. For this, the charge potential on the photoconductor roller can be regulated by the corotron device by adjusting the corotron current (charge regulation), and the discharge potential on the photoconductor roller can be regulated by adjusting the luminous intensity of the character generator (discharge depth regulation). In particular given speed changes, such a regulation can be necessary. However, for this it is required that the potential at the development point on the photoconductor roller can be fixed or that this potential at the development point on the photoconductor roller can be determined.

In order to be able to measure this potential on the photoconductor roller, a potential measurement probe can be arranged between the character generator and the developer station at the photoconductor roller. However, the direct use of the measurement value of the potential measurement probe to regulate the corotron current of the charge device or the luminous intensity of the character generator is not possible since the potential on the photoconductor roller still changes between the location of the potential measurement probe and the development point. The darkness decay rate of the photoconductor roller (thus the spontaneous draining of charge on the photoconductor roller without the effect of light) leads to a reduction of the charge potential both between the charge device and the potential measurement probe and between the position of the potential measurement probe and the development point. The measurement value of the potential measurement probe is less suitable for the regulation of the charge device (darkness decay regulation) depending on how different the distances are between the position of the charge device and the potential measurement probe or between the position of the charging device and the development point. The times that elapse upon rotation of the photoconductor roller depend on these. The effect of the darkness decay rate is therefore also dependent on the rotation speed of the photoconductor roller. However, a direct measurement of the potential at the development point by a sensor is not possible for functional or spatial reasons.

The same relationships also apply to the discharge depth regulation. The discharging of the exposed points on the photoconductor roller is likewise dependent on the time that elapses given rotation of the photoconductor roller between the location of the exposure by the character generator and the location of the potential measurement probe or between the location of the exposure and the location of the development point, and therefore on the rotation speed of the photoconductor roller. In addition to this, the darkness decay rate and the discharge speed are dependent on the environment temperature of the print group due to the changing electron mobility in the photoconductor.

SUMMARY

It is an object to specify a method for an electrophotographic printer to print a recording medium, with which the charging of a photoconductor by a charging device and/or whose discharge is regulated by a character generator, such that a predetermined potential at the development point on the photoconductor roller is maintained, even given altered process speeds, using the measurement values of a potential measurement probe arranged at the photoconductor. For a predetermined speed range at the development point, it should be possible to set a uniform potential value on the photoconductor roller both for the case of charging via the charging device (charge potential at the development point)—for example via the regulation of the corotron current—or for the case of discharging via the character generator (discharge potential at the development point)—for example via the regulation of the luminous intensity of the character generator.

In a method to determine an electrical potential at a predetermined point on a surface of a photoconductor rotating with process speed in an electrophotographic printer, a charge reversal station is arranged at the photoconductor to reverse a charge of the photoconductor. A potential measurement probe is provided adjacent to the photoconductor to measure a potential at the photoconductor. The photoconductor is operated with a speed reduced from the process speed in a ratio of a distance between the charge reversal station and the potential measurement probe and the distance between the charge reversal station and the predetermined point. The potential at the photoconductor is measured via the potential measurement probe which creates a measurement value at the reduced speed. The photoconductor is accelerated to the process speed. The measurement value of the potential measurement probe is used as the electrical potential at the predetermined point.

DESCRIPTION OF EXEMPLARY EMBODIMENTS

Figure 1:
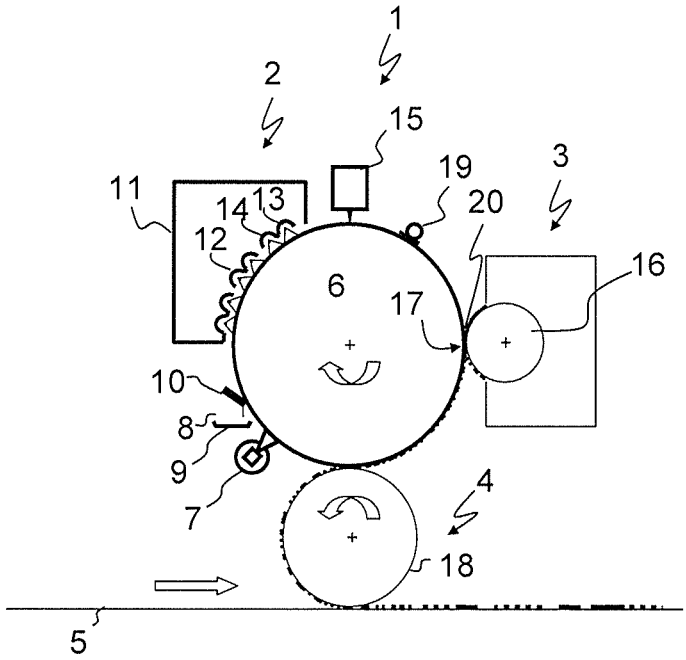
FIG. 1 is a schematic design of a print group of an electrophotographic printer.

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

With the method, the electrical potential can be determined at a predetermined location (in the following, the potential at the development location of the photoconductor roller is stated as an example without the exemplary embodiment being limited to this application case) on the surface of a photoconductor rotating at process speed in an electrophotographic printer. The charge reversal of the photoconductor can take place via a charge reversal station (for example a charging device or a character generator), and a potential measurement probe can be arranged adjacent to the photoconductor to measure the potential at the photoconductor. For measurement, the photoconductor is operated with a speed that is reduced in proportion to the distance between the charge reversal station and the potential measurement probe and the distance between the charge reversal station and the development point, wherein the potential at the photoconductor is measured via the potential measurement probe. The measurement value indicates the potential at the development point. The photoconductor can subsequently be accelerated to process speed, and the measurement value of the potential measurement probe given a reduced speed can continue to be used as a potential of the development point. However, it is a requirement for the cited process that the charge reversal station be controlled in parallel with the speed change and in the same relationship so that the charge density on the photoconductor is not affected by the changed passage times in the charge reversal station.

For example, if the measurement value of the potential measurement probe deviates from a predetermined potential at the development point (in the following the potential at the development point is called the development potential) in the development of charge images, the charge reversal of the photoconductor can be regulated depending on the measurement value given a reduced speed so that the potential measurement probe measures the predetermined development potential. The printer can then again be accelerated to process speed, and the required development voltage or contrast voltage exists between developer station and photoconductor.

An advantage of the method is apparent in that the potential at the development point on the photoconductor roller can be measured by a potential measurement probe that is arranged outside of the developer station. It is therefore possible to measure the development potential before the print operation or during the print operation or to correct the development potential in order to achieve an optimal print quality. The method can in particular be advantageous when printing should take place during speed ramps.

An exemplary embodiment is explained in detail in the following with reference to the schematic drawing figures.

The principle design of a print group 1 is shown in FIG. 1. Such a print group 1 is based on the electrophotographic principle in which a photoconductor image carrier is inked with charged toner particles (for example with the aid of a liquid developer), and the image created in such a manner is transferred onto a recording medium 5.

The print group 1 essentially comprises an electrophotography station 2, a developer station 3 and a transfer station 4.

The core of the electrophotography station 2 is a photoelectric image carrier 6 that has a photoelectric layer on its surface (what is known as a photoconductor). The photoconductor 6 here is designed as a roller (photoconductor 6). The photoconductor roller 6 rotates past the various elements to generate a print image (rotation in the arrow direction)

The photoconductor roller 6 is initially cleaned of all contaminants. For this, an erasure light 7 is present that erases charges still remaining on the surface of the photoconductor roller 6.

After the erasure light 7, a cleaning device 8 mechanically cleans off the photoconductor roller 6 in order to remove toner particles, possible contaminant particles and remaining carrier fluid that are still present on the surface of the protective cap roller 6. The carrier fluid that is cleaned off is supplied to a collection container 9. The cleaning device 8 advantageously has a blade 10 that rests at an acute angle on the generated surface of the photoconductor roller 6 in order to mechanically clean off the surface.

The photoconductor roller 6 is subsequently charged by a charging device 11 (a corotron device 11 in the exemplary embodiment) to an electrostatic charge potential. Multiple corotrons 12 are advantageously present for this. For example, the corotrons 12 have at least one wire 13 to which a high electrical voltage is applied. The air around the wire 13 is ionized by the voltage. A shield 14 can be provided as a counter-electrode. The current (corotron current) that flows across the shield 14 is adjustable so that the charge of the photoconductor roller 6 is controllable. The corotrons 12 can be fed with currents of different strengths in order to achieve a uniform and sufficiently high charge on the photoconductor roller 6.

Arranged after the charging device 11 on the photoconductor roller 6 is a discharging device (here a character generator 15) that discharges the photoconductor roller 6 via optical radiation depending on the desired print image, for example per pixel. A latent discharge image is thereby created that is later inked with toner particles (the inked image corresponds to the print image). For example, an LED character generator 15 can be used in which an LED row with many individual LEDs is arranged stationary over the entire axial length of the photoconductor roller 6. The LEDs can be temporarily controlled individually and with regard to their radiation intensity.

The latent image generated on the photoconductor roller 6 by the character generator 15 is inked with toner particles by the developer station 3. For this, the developer station 3 has a rotating developer roller 16 that directs a layer of liquid developer towards the photoconductor roller 6. A development gap or nip 20 exists between the surface of the photoconductor roller 6 and the surface of the developer roller 16, across which nip 20 the charged toner particles migrate from the developer roller 16 to a development point 17 in the image points on the photoconductor roller 6 due to an electrical field. In the non-image points, no toner particles pass over to the photoconductor roller 6.

The inked image rotates with the photoconductor roller 6 up to a transfer point in which the inked image is transferred onto a transfer roller 18. After the transfer of the print image onto the transfer roller 18, the print image can be transfer-printed onto the recording medium 5.

A potential measurement probe 19 with which the potential on the photoconductor roller 6 can be measured can be arranged between the character generator 15 and the developer station 3, adjacent to the photoconductor roller 6. It would be advantageous if the potential at the development point 17 could be determined from the measurement result of the potential measurement probe 19. That would be important in two cases:

Case a) (see FIG. 2): consideration of the darkness decay rate of the photoconductor roller 6 after its charging via the charging device 11.

After exiting the charging device 11, the charge potential generated on the photoconductor roller 6 by the charging device 11 is slowly dissipating due to the darkness discharge of the photoconductor roller 6. This process continues across the measurement point for the potential measurement probe 19, and only at the position of the development point 17 has it reached the value for the development that is effective for background suppression. This additional potential decay of the measurement point of the potential measurement probe 19 depends on the speed of the photoconductor roller 6 and is therefore dependent on the time that elapses given the rotation of the photoconductor roller 6 between the potential measurement probe 19 and the development point 17. This potential decline can amount to 50 V, for example.

The ratio of the speeds of the photoconductor roller 6 for which the same charged point of the photoconductor roller 6 comes to lie at the potential measurement probe 19 in one case and under the development point 17 in the other case can be calculated from the distances from the exit of the charging device 11 (for example the last shield of the charging corotron 12) to the potential measurement probe 19 or from the exit of the charging device 11 to the development point 17. The speeds thereby have the same relationship as the clearances between the charging device 11 and the potential measurement probe 19 or between the charging device 11 and the development point 17. At the lower speed, the value of the potential that has appeared at the development point 17 at the higher speed (called the process speed in the following) can then be measured by the potential measurement probe 19. It is assumed that the charge potential at the photoconductor roller 6 directly after the charging device 11 is identical in both cases. It is therefore to be taken into account that the corotron current that is required for the same charge potential at the photoconductor roller 6 must be different at different speeds; however, the charging current density must remain the same relative to the surface of the photoconductor roller 6 (identical charging density), meaning that the charging current must change with the speeds in order to achieve the same potential at the measurement point 19 and the development point 17. Since the charging current also depends on the erasure light intensity of the erasure light 7, it is to be ensured that the areal effect of the erasure light 7 is consistent over the speed of the photoconductor roller 6, meaning that that erasure light intensity must be adapted to the speed of the photoconductor roller 6.

Case b) (see FIG. 3): consideration of the discharge depth at the development point 17 at the photoconductor roller 6 after exposure by the character generator 15.

The description of a charged photoconductor roller 6 with the character generator 15 leads to a discharge corresponding to the print image at the exposed points, which discharge is increasingly expressed in the time interval after the exposure, corresponding to the mobility of the generated charge carrier. If the printing process is fast enough, the potential measurement probe 19 will still not be able to measure the fully developed discharge after the exposure, which discharge has developed upon reaching the development point 17. However, the discharge potential at the development point 17 is responsible for the field strength with which the toner is drawn towards the photoconductor roller 6, and therefore determines the degree of inking (and therefore the quality of the printout) on the recording medium 5. In order to be able to keep the discharge potential at the location of the development constant over the speed for a good stability, the measurement value that belongs to the required constant potential value at the development point should be known at the potential measurement probe 19.

The ratio of the speeds for which the same exposed point on the photoconductor roller 6 comes to lie under the potential measurement probe 19 in one case and at the development point 17 in another case can be determined from the distances from the character generator 15 to the location of the potential measurement probe 19 or from the character generator 15 to the location of the development point 17 (the speeds behave like the distances). The potential that develops at the development point 17 at the higher speed can then be measured by the potential measurement probe 19 at the lower speed. It must thereby be taken into account again that the charge reversal of the photoconductor roller 6 by the character generator 15 also depends on the speed of the photoconductor roller 6, meaning that the luminous intensity of the character generator 15 must be adapted corresponding to the speed.

Corresponding to the statements regarding Case a) and Case b), the potential at the development point 17 can thus be measured indirectly with the potential measurement probe 19. The exemplary embodiment is explained further hereafter. It is thereby assumed that the photoconductor roller 6 rotates; the erasure light 7 is active; the charging device 11 is active; and discharge markings are written by the character generator 15.

Regarding Case a):

Here the charging of the photoconductor roller 6 by the charging device ills implemented with a speed of the photoconductor roller 6 that is reduced in relation to the distances between the charging device 11 and the potential measurement probe 19 or between the charging device 11 and the development point 17, and the potential of the photoconductor roller 6 can then be measured by the potential measurement probe 19. The measurement result corresponds to the potential value on the photoconductor roller 6 at the development point 17. With the aid of the measurement result, the charging device 11 can then be regulated so that it charges the photoconductor roller 6 so that the potential measurement probe 19 measures the predetermined potential value at the development point 17. With this setting of the charging device 11 the roller switches to process speed; and it is then ensured that the predetermined potential value is present at the development point 17 at process speed.

Regarding Case b):

According to this principle, the character generator 15 can also be adjusted. Given a speed reduced corresponding to the ratio of the distances between character generator 15 and the potential measurement probe 19 or between character generator 15 and the development point 17, the character generator 15 discharges the photoconductor roller 6 (for example discharge markings on the photoconductor roller 6); and the potential measurement probe 19 measures the potential at the photoconductor roller 6, the measurement result indicating the value of the potential at the development point 17. Depending on the measurement value, the discharge of the photoconductor roller 6 is then regulated by the character generator 15 so that the measurement value of the potential measurement probe 19 assumes the predetermined potential value at the development point 17. With this setting of the character generator 15, the print group 1 is operated at process speed; and it is therefore ensured that the predetermined potential is present at the development point 17. For example, this method can be implemented while maintaining the setting of the charging device 11 corresponding to Case a).

The method according to Case a) and Case b) can be implemented at different process speeds, and the measurement values of the potential measurement probe 19 can thereby be stored in a table, for example, from which it results how the charging device 11 or the character generator 15 must be adjusted in order to ensure the predetermined potential at the development point 17. The measurement value of the potential measurement probe 19 after adjusting the charging device 11 or the character generator 15 can additionally be incorporated into the table.

Figure 2:
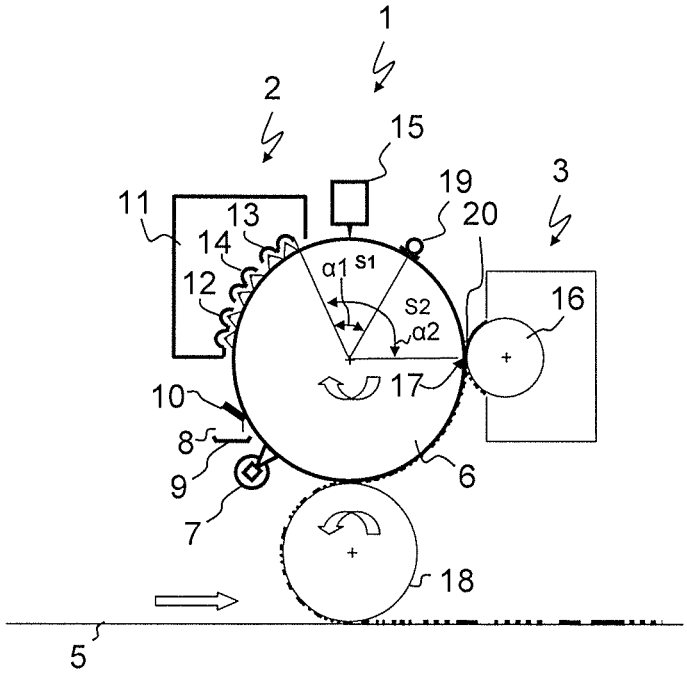
FIG. 2 shows the print group with a drawing of the clearances between the charging device and the potential measurement probe or between the charging device and the development point on the photoconductor roller.
Figure 3:
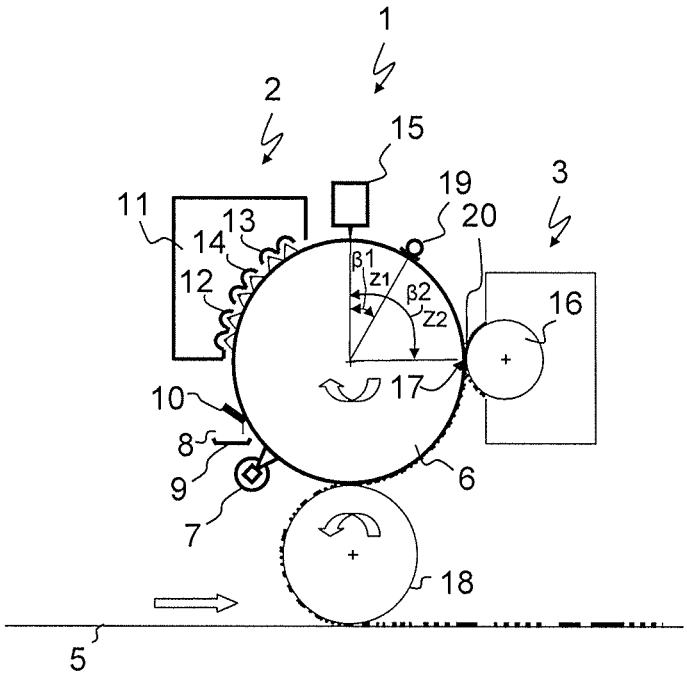
FIG. 3 illustrates the print group with a drawing of the clearances between the character generator and the potential measurement probe or between the character generator and the development point on the photoconductor roller.

The exemplary embodiment is explained further by reference to FIGS. 2 and 3. A predetermined development potential on the photoconductor roller 6 should exist at the development point 17, which predetermined development potential should be present even at different process speeds. Furthermore, initial values are established for the potential values at the charging device 11 to charge the photoconductor roller 6 and at the character generator 15 to discharge the photoconductor roller 6.

The angle alpha $\alpha_1$ between the charging device 11 and the potential measurement probe 19 or the angle $\alpha_2$ between the charging device 11 and the development point 17 is plotted in FIG. 2. These angles correspond to radian measures s. The angle $\alpha_1$ corresponds to the radian measure $s_1$, and the angle $\alpha_2$ corresponds to the radian measure $s_2$. The reduced speed $v_{charge}$ for indirect measurement of the potential at the development point 17 via the potential measurement probe 19 then amounts to:

$$v_{charge}=s_1/s_2*v_{proc} \text{ if } v_{proc} \text{ is the process speed.}$$

One requirement is the temporal consistency for the formation of the potential decay due to the darkness decay at the photoconductor roller 6:

$$t_{meas}=s_1/v_{charge}=s_2/v_{proc}=t_{dev},$$

when $t_{meas}$ or $t_{dev}$ are the times that a defined point on the photoconductor roller 6 requires, as of being charged by the charging device 11, until it reaches the potential measurement probe 19 or the development point 17.

The angle $\beta_1$ between the character generator 15 and the potential measurement probe 19 or the angle $\beta_2$ between the character generator 15 and the development point 17 is drawn in FIG. 3. These angles $\beta$ correspond to radian measures z. The radian measure $z_1$ corresponds to the angle $\beta_1$, and the radian measure $z_2$ corresponds to the angle $\beta_2$. The reduced speed $v_{dev1}$ for indirect measurement of the potential at the development point 17 by the potential measurement probe 19 is then:

$$v_{dis1}=z_1/z_2*v_{proc} \text{ if } v_{proc} \text{ is the processing speed.}$$

One requirement is again the temporal consistency for developing the discharge level at the photoconductor roller 6:

$$t_{meas}=z_1/v_{dis1}=z_2/v_{proc}=t_{dev}$$

$t_{meas}$ or $t_{dev}$ are the times that a defined point on the photoconductor roller 6 requires, as of being discharged by the charging device 15, until it reaches the potential measurement probe 19 or the development point 17.

Since the predetermined potential value for charging the photoconductor roller 6 at the development point 17 after the charging by the charging device 11 should be maintained at the different process speeds or since the predetermined potential value for the discharging at the photoconductor roller 6 at the development point 17 should be maintained at the different process speeds (Case a) and b)), it is necessary to determine desired values for the charging and discharging of the photoconductor roller 6 with the correlations presented above and depending on the process speed, which desired values are set via the potential measurement probe 19. Two respective reduced speeds $v_{charge1}$ and $v_{dis1}$ thus belong to a given process speed, with the aid of which two reduced speeds the desired values for the charging via the charging device 11 or the discharging via the character generator 15 can be determined via their regulation with the aid of the measurement value of the potential measurement probe 19.

In principle, for both the charge level and the discharge depth a two-dimensional characteristic curve field exists across the charging current of the charging device on the one hand or the light energy of the character generator on the other hand, and the process speed. Via the specification or indirect measurement capability of desired or real values of the potentials at the developer point 17, the measurement value detection can be limited to the determination of a respective characteristic curve across the process speed.

In order to accommodate the values for the characteristic lines depending on the allowed process speeds, the following can be assumed:

1st Step (Regulation of the Charge Potential):

A predefined initial desired value for the charge potential at the photoconductor roller 6 is adjusted with the aid of the potential measurement probe 19. For the respective process speeds, these are converted to reduced speeds at a ratio of $s_1/s_2$ and are adjusted. The potential at the development point 17 is then known via the measurement of the potential on the photoconductor roller 6 via the potential measurement probe 19. If the measurement value deviates from the potential desired value at the development point 17, the charge is regulated by the charging device 11 with the aid of the measurement value so that the measurement value assumes the predetermined desired potential value at the development point 17 (corrected desired charging value for the charging device 11). In this step it must be taken into account that the charging of the photoconductor roller 6 is different in comparison to the process speed given a reduced speed of the photoconductor roller 6. In order to dispel this problem, the charging current is additionally corrected downward by the charging device 11 by a factor of $s_1/s_2$ in order to keep the charging density constant, and in order to make the potential after the charging device 11 independent of this speed change.

2nd Step:

The speed of the photoconductor roller 6 is increased to process speed; and the charging via the charging device 11 is maintained, wherein it is taken into account that the charging current of the charging device 11 must be corrected upward again by a factor $s_2/s_1$ due to the change of the speed of the photoconductor roller 6 to the process speed in order to keep the charging density constant. The charging values that are then measured can then be plotted as a characteristic line, "corrected desired control value of charging via the charging device 11" over the process speed. From the characteristic line it can then be learned what potential on the photoconductor roller 6 must be adjusted at the position of the potential measurement probe 19 at the respective process speed in order generate the predetermined charge potential at the development point 17.

The discharging of the photoconductor roller 6 by the character generator 15 can then be adjusted with these values.

3rd Step:

A predefined desired initial value for the discharging of the photoconductor roller 6 via the character generator 15 is adjusted via the potential measurement probe 19. The desired control value determined from the characteristic line according to Step 1 should thereby be used for the charging.

The speed of the photoconductor roller 6 is subsequently reduced by a factor of $z_1/z_2$. The control value of the discharge of the photoconductor roller 6 is simultaneously corrected due to a change of the speed by the factor of $z_1/z_2$. The measurement of the potential via the potential measurement probe 19 then yields the potential value at the development point 17. If the measured value deviates from the predetermined desired potential value at the development point 17, the character generator 15 is regulated depending on the measurement value so that the potential measurement probe 19 measures the predetermined potential value at the development point 17 (corrected desired discharge value for the character generator 15). The character generator 15 should be operated further with this corrected desired value. At the different process speeds, the discharge values of the character generator 15 are determined in this way as corrected desired values and are stored.

Step 4:

In the next step, the speed of the photoconductor roller 6 is increased to process speed; the discharge of the photoconductor roller 6 by the character generator 15 is maintained, wherein it is taken into account that the control value of the discharging must be corrected upward by a factor of $z_2/z_1$ due to a change of the speed of the photoconductor roller 6 to the process speed.

The discharge values that are then measured at different speeds can then be plotted as a characteristic line "corrected desired control value of discharging for the character generator 15" over the process speed. From the characteristic line it can then be learned what potential at the position of the potential measurement probe 19 at the photoconductor roller 6 must be adjusted by the character generator 15 at the respective process speed in order to generate the predetermined potential at the development point 17.

Via the method illustrated above, corrected desired control values for the charging of the photoconductor roller 6 by the charging device 11 and corrected desired values for the discharging of the photoconductor roller 6 by the character generator 15 can be obtained and, for example, can be stored in a table in the printer controller. These desired control values can be used in print operation in order to control the charging device 11 and the character generator 15 so that the predetermined development potential and contrast potential are present at the development point 17 on the photoconductor roller 6, for example at discharge markings generated on the photoconductor roller 6. Furthermore, it is advantageous to implement the method upon starting a printer or at adjustable points in time, or given a change of parameters (for example given a change of the potential at the developer roller 16) in the print operation.

In Steps 1 and 3, the initial setting of predefined desired control values and the subsequent review of the potential values at the developer point 17 can be omitted for simplification.

The photoconductor can preferably be designed in the form of a roller, or also as a continuous belt. LED rows or also lasers with a corresponding scanning mechanism can be used as a character generator 15.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

I claim as my invention:

1. A method to determine an electrical potential at a predetermined point on a surface of a photoconductor rotating with process speed in an electrophotographic printer, a charge reversal station being arranged at the photoconductor to reverse a charge of the photoconductor, comprising the steps of:

arranging a potential measurement probe adjacent to the photoconductor to measure a potential at said photoconductor;

operating the photoconductor with a speed reduced from said process speed in a ratio of a distance between the charge reversal station and the potential measurement probe and the distance between the charge reversal station and the predetermined point;

measuring said potential at said photoconductor via the potential measurement probe which creates a measurement value at said reduced speed;

accelerating the photoconductor to said process speed; and using the measurement value of the potential measurement probe as said electrical potential at the predetermined point.

2. The method according to claim 1 in which the charge reversal of the photoconductor at said reduced speed by the charge reversal station is regulated depending on the potential measured by the potential measurement probe so that said measured potential assumes a desired value for the predetermined point.

3. The method according to claim 2 in which:

said charge reversal station is used as a charging device of the electrophotographic printer that charges the photoconductor to a charge potential;

the predetermined point on the photoconductor being a development point on the photoconductor that is situated opposite a developer station;

said development point should have a predetermined charge potential;

the speed of the photoconductor being reduced via a ratio factor s1/s2 of the distance s1 of the charging device from the potential measurement probe and the distance s2 from the charging device to the development point;

the potential at the photoconductor being measured by the potential measurement probe at the reduced speed;

the charging device being regulated so that the potential measurement probe measures the predetermined charge potential; and the reduced speed of the photoconductor being increased to the process speed while maintaining the regulating of the charging device.

4. The method according to claim 3 in which a control value of the charging of the photoconductor by the charging device is decreased by the ratio factor of s1/s2 before the regulating.

5. The method according to claim 4 in which the control value of the charging of the photoconductor by the charging device is decreased by a ratio factor of s2/s1 after the regulating.

6. The method according to claim 5 in which the charging device is a corotron device whose corotron current is regulated depending on the measurement value of the potential measurement probe, and is thereby scaled with the ratio factor $s_1/s_2$ or $s_2/s_1$.

7. The method according to claim 1 in which:

the charge reversal station is used as a discharge device that discharges the photoconductor to a discharge potential;

the predetermined point on the photoconductor is a development point on said photoconductor that is situated opposite a developer station;

said development point should have a predetermined discharge potential;

the speed of the photoconductor is reduced by a ratio factor $z_1/z_2$ of a distance $z_1$ of the discharge device from the potential measurement probe and a distance $z_2$ from the discharge device to the development point;

the potential on the photoconductor is measured by the potential measurement probe at said reduced speed;

the discharge device is regulated so that the potential measurement probe measures said predetermined discharge potential; and the speed of the photoconductor is increased to the process speed while maintaining the regulating of the discharge device.

8. The method according to claim 7 in which a control value of the discharge of the photoconductor is decreased by the discharge device by the ratio factor of $z_1/z_2$ before the regulating.

9. The method according to claim 8 in which the control value of the discharge of the photoconductor is decreased by the discharge device by a ratio factor of $z_2/z_1$ after the regulating.

10. The method according to claim 9 in which the discharge device is a character generator whose luminous intensity is regulated depending on the measurement value of the potential measurement probe, and is thereby scaled with the ratio factor of $z_1/z_2$ or $z_2/z_1$.

11. The method according to claim 3 in which the photoconductor is discharged by a character generator to a discharge potential, and the potential at the photoconductor is measured by the potential measurement probe;

the predetermined point on the photoconductor should have a predetermined discharge potential;

the speed of the photoconductor is reduced by a ratio factor $z_1/z_2$ of a distance $z_1$ of the character generator from the potential measurement probe and a distance $z_2$ of the character generator from the development point;

the potential at the photoconductor is measured by the potential measurement probe at said reduced speed;

the character generator is regulated so that the potential measurement probe measures the predetermined discharge potential; and the speed of the photoconductor is increased to the process speed while maintaining the regulating of the character generator.

* * * * *